US007836800B2

(12) United States Patent
Wilson, Jr. et al.

(10) Patent No.: US 7,836,800 B2
(45) Date of Patent: Nov. 23, 2010

(54) TOOL FOR TIGHTENING AND LOOSENING A FASTENER

(75) Inventors: Robert James Wilson, Jr., Macedon, NY (US); Edward Cobb, Webster, NY (US)

(73) Assignee: Harris Corporation, Melbourne, FL (US)

( * ) Notice: Subject to any disclaimer, the term of this patent is extended or adjusted under 35 U.S.C. 154(b) by 176 days.

(21) Appl. No.: 12/199,301

(22) Filed: Aug. 27, 2008

(65) Prior Publication Data

US 2010/0050822 A1 Mar. 4, 2010

(51) Int. Cl.
*B25B 13/48* (2006.01)
*B25B 13/56* (2006.01)

(52) U.S. Cl. ..... 81/176.15; 81/461; 81/185.1; 81/121.1

(58) Field of Classification Search ..... 81/176.1–176.3, 81/461, 185.1–185.2, 121.1, 177.85
See application file for complete search history.

(56) References Cited

U.S. PATENT DOCUMENTS 2,770,991 A * 11/1956 Myers ..... 81/176.15
3,094,022 A * 6/1963 Young ..... 81/53.2
3,233,482 A * 2/1966 Jaehne ..... 81/185
4,663,998 A 5/1987 Parsons et al.
5,400,680 A * 3/1995 Spangler ..... 81/176.15
5,875,694 A * 3/1999 Graf ..... 81/461
6,170,364 B1 * 1/2001 Johnson ..... 81/176.1
7,328,636 B2 2/2008 Camacho
2002/0139225 A1 * 10/2002 Carter ..... 81/176.3

* cited by examiner

*Primary Examiner*—D. S Meislin
(74) *Attorney, Agent, or Firm*—Fox Rothschild, LLP; Robert J. Sacco

(57) ABSTRACT

A socket (204, 600) is provided for use with a wrench (202) having a shaft (216) to drive the socket for tightening or loosening a fastener (206) having a gripping notch (218). The socket includes a main body (306, 610) and at least one removable driver (308, 310, 602, 604, 606, 608). The main body has a recess (214, 720) being of such dimensions that at least a portion of the fastener fills the recess when inserted therein. The main body further comprises a guide (402, 804) configured for aligning the socket and the fastener. The removable driver has at least one driving element (342, 344, 760, 762) sized and shaped to fit within the gripping notch of the fastener. The removable driver is removably disposed within the main body in an orientation in which a driving element at least partially protrudes into the recess.

19 Claims, 6 Drawing Sheets

TOOL FOR TIGHTENING AND LOOSENING A FASTENER

BACKGROUND OF THE INVENTION

1. Statement of the Technical Field

The invention relates to tightening and loosening tools, and more particularly, tools configured for tightening or loosening fasteners (e.g., nuts or bolts).

2. Description of the Related Art

There are many types of tool assemblies known in the art that are useful for fastener tightening and loosening operations. One such conventional tool assembly is a socket wrench assembly. As should be understood, a socket wrench assembly typically includes a wrench and removable sockets. The wrench and removable sockets collectively provide a mechanism that allows fasteners (e.g., nuts and bolts) to be tightened or loosened with a continuous motion.

The removable socket is typically formed of a heat treated alloy steel. The removable sockets can be sized and shaped to fit different fasteners (e.g., nuts and bolts). For example, a removable socket can be sized and shaped to fit slotted, notched, spanner, castle, or castellated nuts and bolts. A perspective view of such a removable socket and a slotted nut is provided in FIG. 1. As shown in FIG. 1, the removable socket 100 is comprised of two opposing ends 106, 108. A square aperture 102 is formed in a first one of the opposing ends 106. It should be noted that the square aperture 102 is often formed in a separate component (not shown) that is inserted into the removable socket 100 and welded thereto. The square aperture 102 is sized and shaped to receive a driving shaft or fitting of the wrench. The removable socket 100 typically comes in a variety of sizes. Such sizes often include a fourth of an inch size (¼"), a three-eighths of an inch size (⅜"), a half of an inch size (½"), a three fourth of an inch size (¾"), and a one inch size (1").

A plurality of drivers (or protrusions) 104 are formed in a second one of the opposing ends 108. The drivers 104 are sized and shaped to fit into gripping slots (or notches) 116 of a slotted nut 114. As such, the number of positions that the removable socket 100 can adopt when engaging the slotted nut 114 is limited. The drivers 104 are provided to drive the slotted nut 114 when actuated by a wrench for purposes of tightening the slotted nut 114 or loosening the slotted nut 114.

The above described conventional tool assembly suffers from certain drawbacks. For example, the removable socket 100 is relatively expensive and labor intensive to manufacture, repair, and/or replace. The removable socket 100 also has a relatively short lifespan. Also, if the removable socket 100 is not substantially aligned with the slotted nut 114 or the drivers 104 are worn, then the drivers 104 of the removable socket 100 can dislodge from the gripping slots (or notches) 116 of the slotted nut 114 when the tool assembly is in use. As a result of this dislodgement, the removable socket 100 can damage the slotted nut 114 and/or a chassis in which the slotted nut 114 is being coupled to.

In view of the forgoing, there is a need for a tool assembly comprising a removable socket that is less expensive to manufacture, repair, and/or replace. There is also a need for a removable socket with a longer life span as compared to the conventional removable sockets. There is further a need for a removable socket configured to ensure that the drivers will not dislodge from gripping slots (or notches) of a fastener when a tool assembly is being used.

SUMMARY OF THE INVENTION

This Summary is provided to comply with 37 C.F.R. §1.73, requiring a summary of the invention briefly indicating the nature and substance of the invention. It is submitted with the understanding that it will not be used to interpret or limit the scope or meaning of the claims.

The present invention concerns a socket for use with a wrench having a shaft to drive the socket for tightening or loosening a fastener having at least one gripping notch. The socket includes a main body, at least one removable driver, and a retaining plate. The main body has a recess being of such dimensions that at least a portion of the fastener fills the recess when inserted therein. The main body also has a guide configured for aligning the socket and the fastener. The guide is defined by a peripheral edge of the main body surrounding the recess. The main body further comprises a stop ledge configured for ensuring that the fastener is inserted a predefined distance within the recess.

The removable driver has at least one driving element sized and shaped to fit within the gripping notch of the fastener. The removable driver is removably disposed within the main body in an orientation in which the driving element at least partially protrudes into the recess. The retaining plate is removably coupled to the main body so as to retain the removable driver within the main body.

According to an embodiment of the invention, the removable driver comprises two opposing driving elements sized and shaped to fit within the gripping notch. In such a scenario, the removable driver is removably disposed within the main body in a first or second orientation, wherein the first orientation is opposite to the second orientation. In the first orientation, a first one of the two opposing driving elements protrudes into the recess. In the second orientation, a second one of the two opposing driving members protrudes into the recess.

According to another aspect of the invention, the socket includes a plate having a centrally located aperture sized and shaped to engagingly receive the shaft for rotation therewith. The plate is removably secured to a first end of the main body opposed from a second end of the main body in which the recess is formed. The main body comprises an aperture having dimensions greater than dimensions of the shaft and aligned with the centrally located aperture of the plate.

BRIEF DESCRIPTION OF THE DRAWINGS

Embodiments will be described with reference to the following drawing figures, in which like numerals represent like items throughout the figures, and in which.

DETAILED DESCRIPTION OF THE PREFERRED EMBODIMENTS

The invention concerns tool assemblies configured for tightening or loosening fasteners (e.g., nuts and bolts). Tool assemblies according to embodiments of the invention overcome certain drawbacks of conventional tool assemblies. For example, the tool assemblies of the present application are less expensive and labor intensive to manufacture, repair, and/or replace as compared to conventional tool assemblies. The tool assemblies of the present application comprise a guide for ensuring proper alignment of a removable socket and a fastener (e.g., a nut and a bolt). The tool assemblies of the present application comprise reversible and replaceable drivers. As a result of the guide and reversible/replaceable drivers, the tool assemblies of the present application eliminate a dislodgement drawback of conventional tool assemblies. The above described features of the tool assemblies will become evident as the discussion progresses.

The invention will now be described more fully hereinafter with reference to accompanying drawings, in which illustrative embodiments of the invention are shown. This invention, may however, be embodied in many different forms and should not be construed as limited to the embodiments set forth herein.

Before describing the tool assemblies of the present invention, it will be helpful in understanding an exemplary environment in which the invention can be utilized. In this regard, it should be understood that the tool assemblies of the present invention can be utilized in a variety of different applications where fasteners (e.g., nuts) need to be tightened or loosened. Such applications include, but are not limited to, military applications, automotive applications, shipping applications, electronic applications, and industrial applications.

Figure 1:
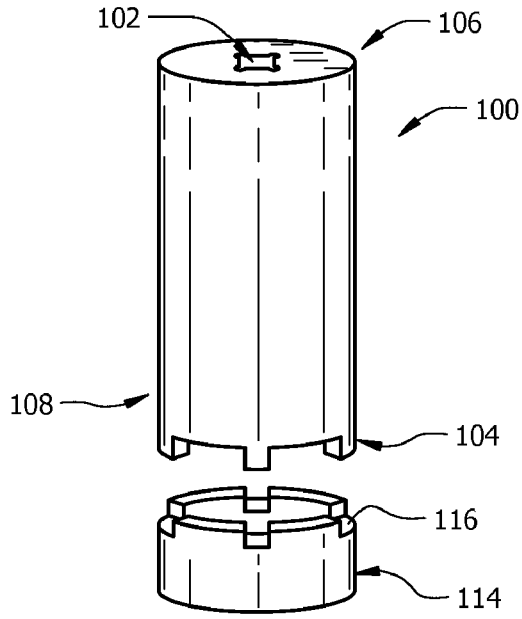
FIG. 1 (Prior Art)
FIG. 1 is a perspective view of a conventional removable socket and a slotted nut.
Figure 2:
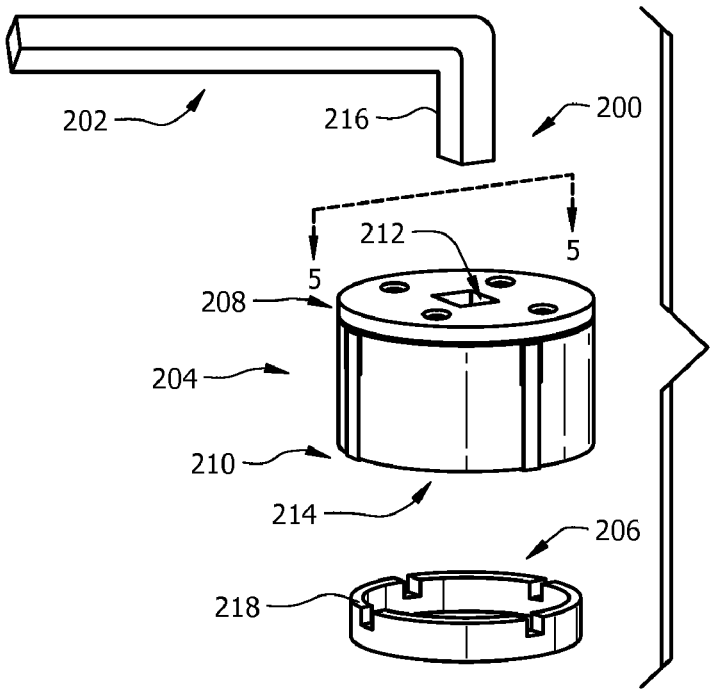
FIG. 2 is a perspective view of a tool assembly that is useful for understanding the present invention.

Referring now to FIG. 2, there is provided a perspective view of a tool assembly 200 that is useful for understanding the present invention. The tool assembly 200 is comprised of a wrench 202 and a removable socket 204. The wrench 202 and removable socket 204 collectively provide a mechanism that allows the fastener 206 (e.g., a slotted, a notched, a spanner, a castle, and a castellated nut and bolt) to be tightened or loosened. Although the wrench 202 shown in FIG. 2 is a manual wrench, the invention is not limited in this regard. For example, the wrench 202 can be any manual or power wrench known to those having ordinary skill in the art for applying a rotational force to a removable socket 204. Similarly, the invention is not limited by the exterior shape of the removable socket 204 shown in FIG. 2. In this regard, it should be understood that the removable socket 204 can have any exterior shape selected in accordance with a particular tool assembly application. Such shapes include, but are not limited to, a circular shape and a hex shape.

As shown in FIG. 2, the removable socket 204 comprises two opposing ends 208, 210. An aperture 212 is formed in a first one of the opposing ends 208. The aperture 212 can have a shape configured to engagingly receive and lock onto a driving shaft (or member) 216 of the socket wrench 202. In operation, the socket wrench 202 applies a rotational force to the removable socket 204 coupled thereto. It should be noted that the aperture 212 can have any shape and size selected in accordance with a particular driving shaft (or member) configuration. For example, if the driving shaft (or member) 216 has a rectangular shape (as shown in FIG. 2), then the aperture 212 has a rectangular shape. Similarly, if the driving shaft (or member) 216 has a hex shape (not shown), then the aperture 212 has a hex shape. The invention is not limited in this regard.

Referring again to FIG. 2, a recess 214 is formed in a second one of the opposing ends 210. The recess 214 is sized and shaped to fit a particular sized and shaped fastener 206 (e.g., a slotted, notched, spanner, castle, or castellated nut and bolt). Although the fastener 206 shown in FIG. 2 is a nut having a circular shape, the invention is not limited in this regard. For example, the fastener 206 can have a hex-shape. In such a scenario, the recess 214 can have a size and a hex-shape suitable to fit the hex-shaped fastener. Notably, the recess 214 is designed so that the portion of the fastener 206 inserted therein substantially fills the recess 214. Still, it should be understood that recess 214 can have a circular shape regardless of the shape of a fastener 206 having notches. This circular configuration can be employed since drive forces are obtained by drivers (described below in relation to FIGS. 3-4) rather than the shaped recess 214.

As also shown in FIG. 2, the fastener 206 can comprise at least one gripping slot (or notch) 218 formed therein. The gripping slot (or notch) 218 provides a means for gripping the fastener 206 so that the fastener 206 can be driven by the removable socket 204. An exemplary embodiment of the removable socket 204 will be described in further detail below in relation to FIGS. 3-5. Another exemplary embodiment of the removable socket will be described below in relation to FIGS. 6-8.

Figure 3:
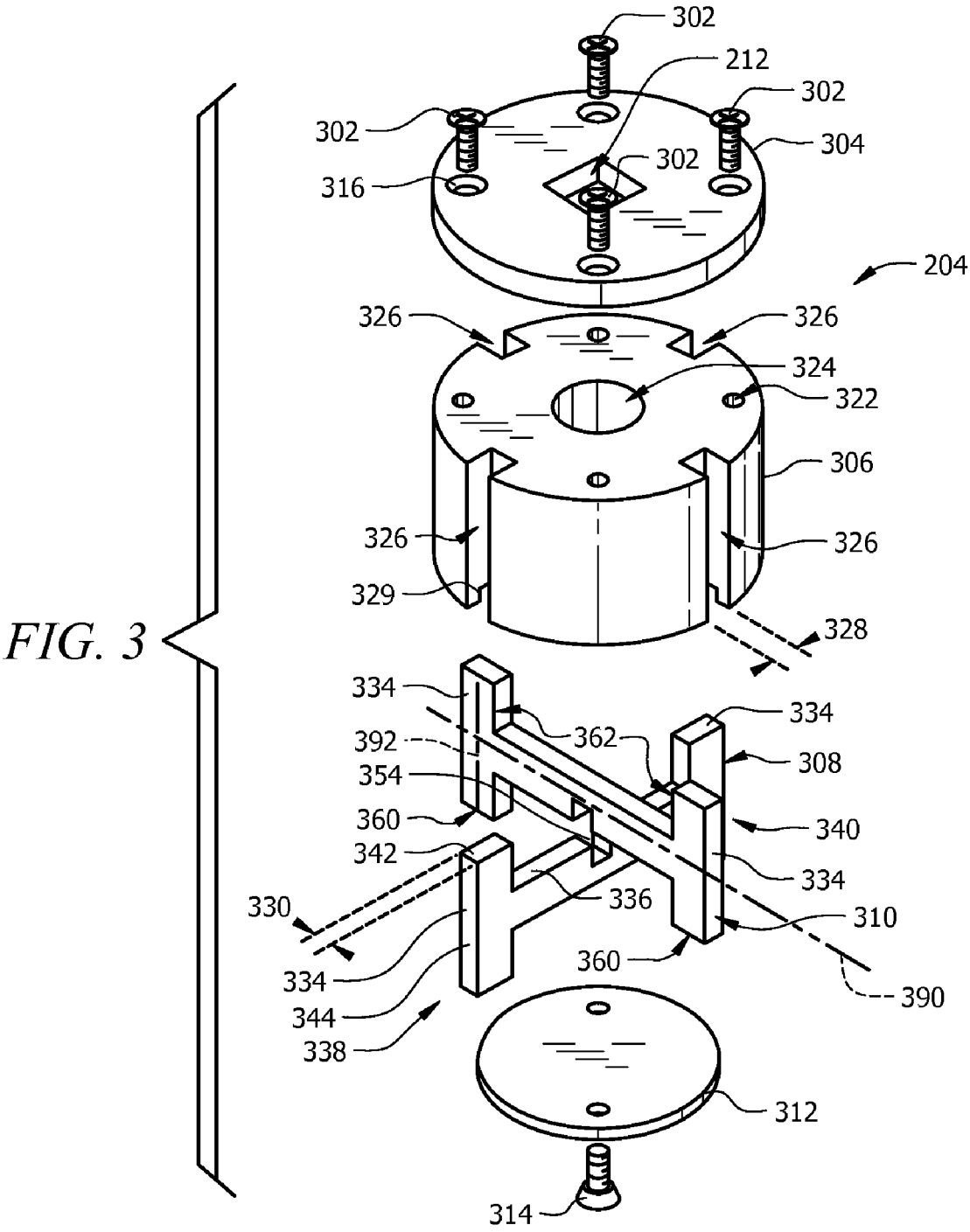
FIG. 3 is an exploded perspective view of an exemplary removable socket of the tool assembly shown in FIG. 2 that is useful for understanding the present invention.
Figure 4A:
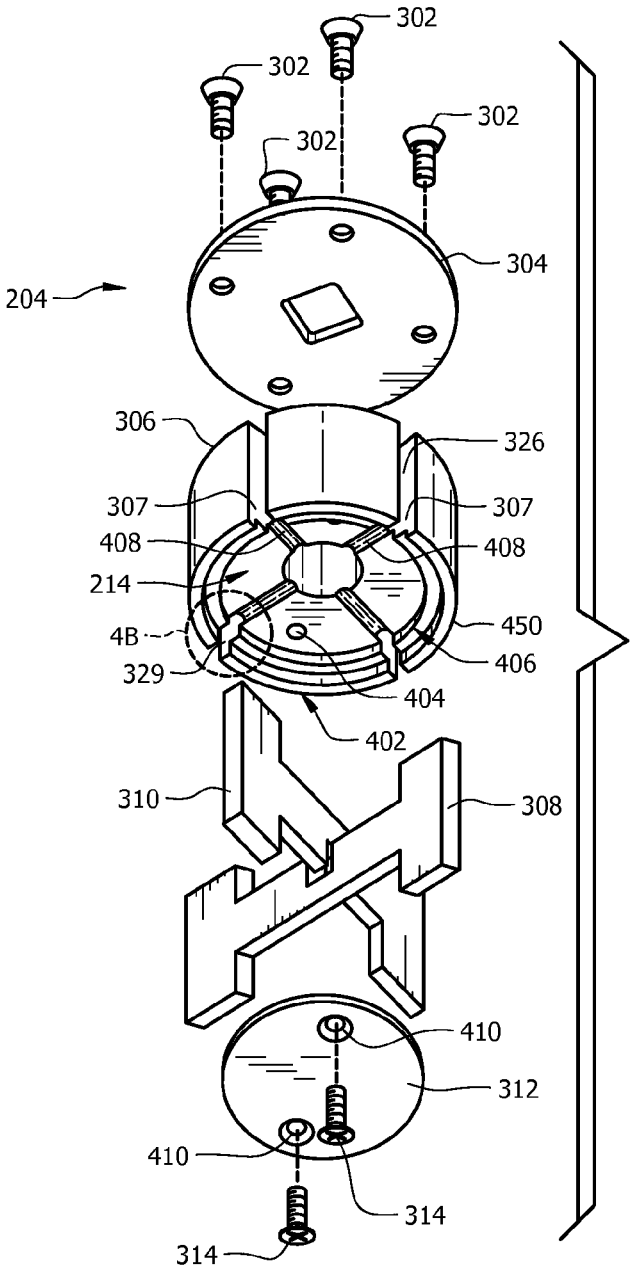
FIG. 4A is an exploded perspective view of an exemplary removable socket of the tool assembly shown in FIG. 2 that is useful for understanding the present invention.
Figure 4B:
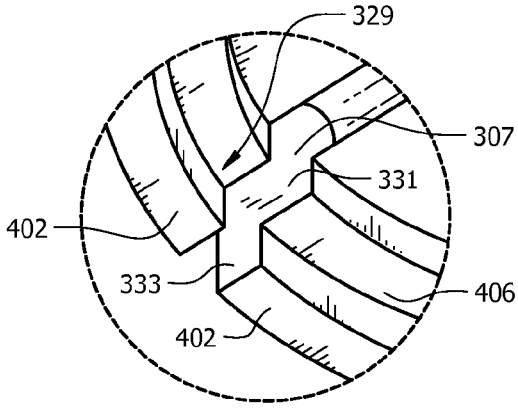
FIG. 4B is an enlarged view of a portion of the tool assembly in FIG. 4A.
Figure 5:
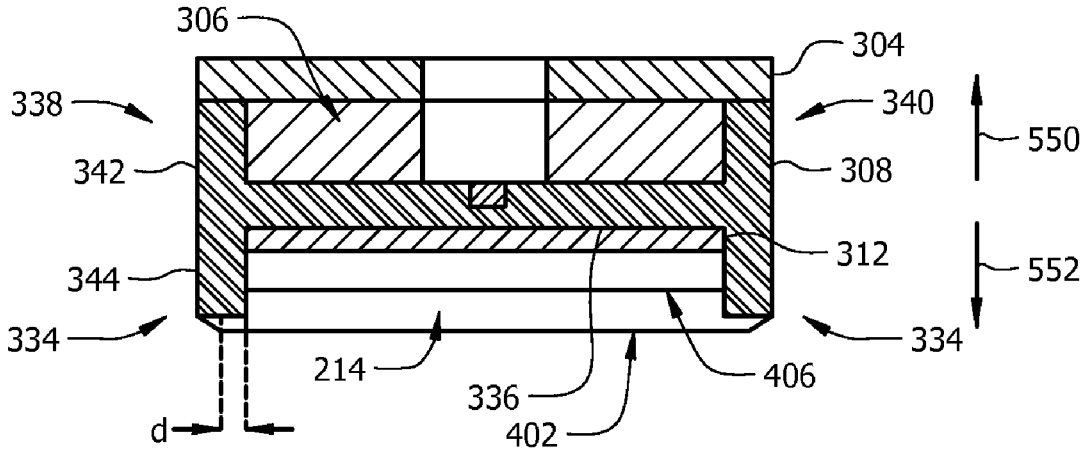
FIG. 5 is a cross-sectional view of the assembled removable socket taken along lines 5-5 of FIG. 2.

Referring now to FIGS. 3-5, there are provided additional illustrations of the removable socket 204. More particularly, exploded perspective views of the removable socket 204 are provided in FIGS. 3-4. A cross-sectional view taken along line 5-5 of FIG. 2 is provided in FIG. 5. It should be understood that the removable socket 204 can come in a variety of sizes. For example, the removable socket 204 can have a size of a forth of an inch (¼"), three-eighths of an inch (⅜"), half of an inch (½"), three-fourths of an inch (¾"), and one inch (1"). The invention is not limited in this regard. For example, the removable socket 204 can have a size denominated in a metric unit.

As shown in FIGS. 3-4, the removable socket 204 is comprised of mechanical connectors 302, 314, plates 304, 312, a main body 306, and drivers 308, 310. The plates 304, 312 can be removably coupled to the main body 306 via the respective mechanical connectors 302, 314. Each of the mechanical connectors 302, 314 can be any mechanical connector commonly used in the art for securing various types of components together. Such mechanical connectors include, but are not limited to, rivets, pins, and screws (as shown in FIGS. 3-4).

The plate 304 is comprised of apertures 316, 212. The apertures 316 are sized and shaped for receiving the mechanical connectors 302. The aperture 212 is sized and shaped for receiving the driving shaft (or member) 216 of the socket wrench 202 (described above in relation to FIG. 2). As such, the aperture 212 has dimensions selected in accordance with a particular driving shaft (or member) 216 configuration. The plate 304 can be formed of any suitable material known to those having ordinary skill in the art. Such materials include, but are not limited to, heat treated steel.

Although the removable socket 204 is shown to have a single plate 304, the invention is not limited in this regard. For example, the socket 204 can comprise a plurality of plates 304. The plates 304 can be laminated together. In such a scenario, a torque loading is distributed over an increased area, i.e., each of two stacked plates experience half of the torque loading as a single plate 304. As should be understood by those skilled in the art, the phrase "torque loading", means a loading as a result of torque.

It should be noted that the plate 304 is a removable component of the socket 204. As such, the plate 304 can be replaced with a different plate (not shown) having an aperture 212 with dimensions and shapes selected in accordance with a particular socket wrench employed (e.g., a wrench with a square-shaped driving shaft and a wrench with a hex-shaped driving shaft). Notably, the replaceable plate 304 configuration provides a universal tool assembly 200 that can be used with wrenches having different shaped driving shafts (or members).

Also, the replaceable plate 304 configuration provides a tool assembly 200 that is less expensive to manufacture and repair as compared to conventional tool assemblies. In this regard, it should be understood that only the plate 304 needs to be machined for each of the wrenches having different shaped driving shafts. In contrast, an entire conventional removable socket or conventional adapter needs to be machined for each of the wrenches having different shaped driving shafts. Similarly, only the plate 304 needs to be replaced when the aperture 212 becomes worn so that it no longer engagingly receives the driving shaft (or member) 216 of the wrench 202 for rotation therewith. One can appreciate that it is less expensive to machine a plate 304 as compared to the cost of machining a conventional removable socket and/or a conventional wrench adapter.

Further, the replaceable plate 304 eliminates certain drawbacks of conventional wrench adaptors. In this regard, it should be understood that conventional wrench adapters permit the drive tool (e.g., wrench 202 of FIG. 2) to flex at the joint connected to the adapter. As a result of this joint flexing, the drive tool and the aperture 212 of the socket can become prematurely worn.

Referring again to FIGS. 3-4, the main body 306 is formed of any suitable material known to those having ordinary skill in the art. Such materials include, but are not limited to, various metals (such as steel and brass). The main body 306 is comprised of apertures 322, 324, slots 326, and a recess 214. The apertures 322 are sized and shaped for receiving the mechanical connectors 302. According to an embodiment of the invention, the mechanical connectors 302 are threaded mechanical connectors. In such a scenario, the apertures 322 are threaded apertures in which the mechanical connectors 302 can screwingly engage. The invention is not limited in this regard.

The aperture 324 of the main body 306 is sized and shaped for receiving the driving shaft (or member) 216 of the wrench 202 (described above in relation to FIG. 2). In this regard, it should be understood that the aperture 324 can have dimensions (not shown) selected for receiving driving shaft (or member) 216 having different sizes. As such, the main body 306 can be used in tool assembly applications where wrenches with different sized and shaped driving shafts (or members) are employed for tightening or loosening fasteners (e.g., a nut). One can appreciate that such a main body 306 configuration facilitates a universal tool assembly 200 that is less expensive to manufacture and repair as compared to conventional tool assemblies.

Figure 7:
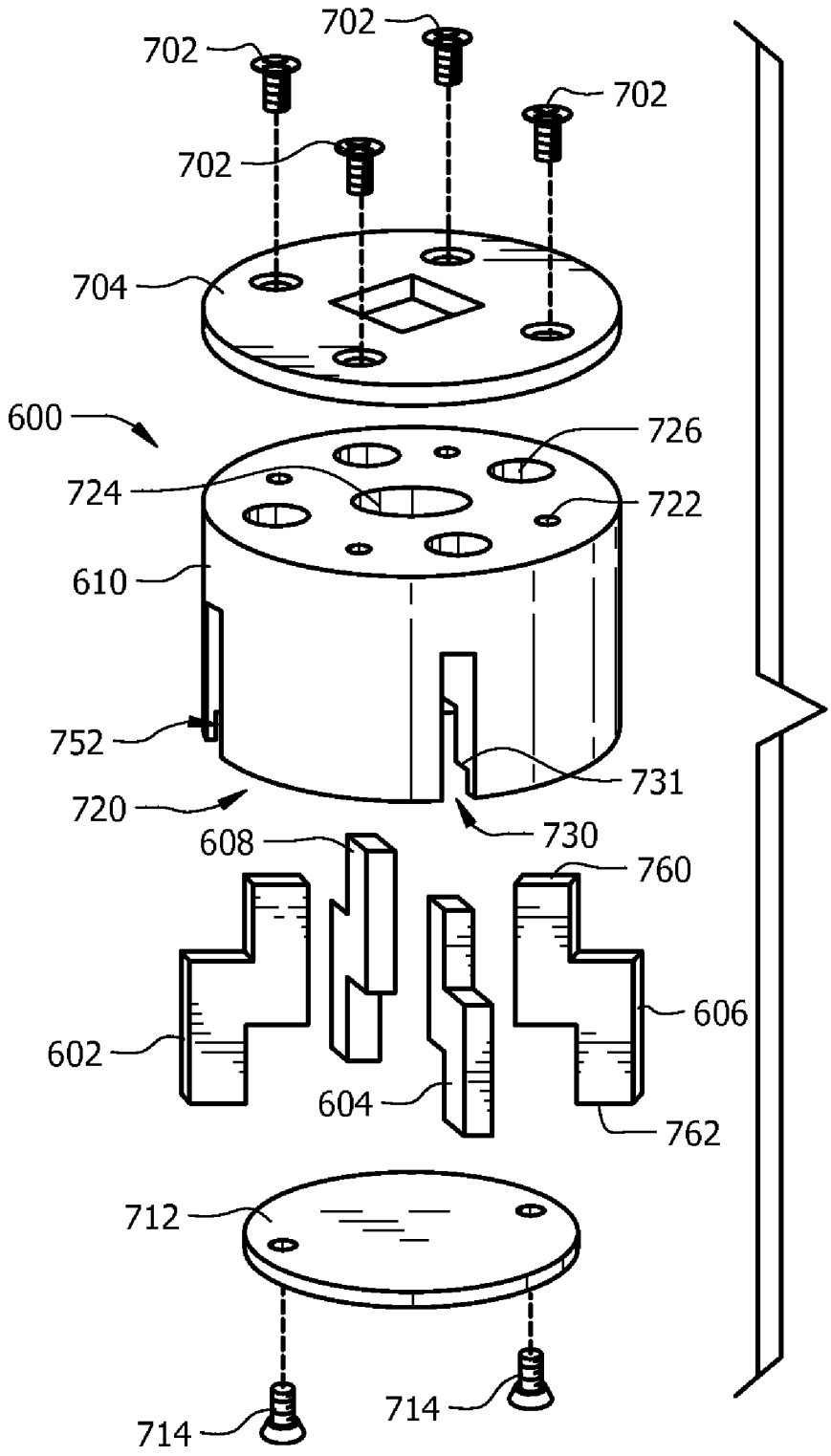
FIG. 7 is an exploded perspective view of the exemplary removable socket of FIG. 6.

The slots 326 are provided for receiving at least a portion 334 of a driver 308, 310. The slots 326 can have any shape selected in accordance with a particular socket 204 application. Such shapes include, but are not limited to, cylindrical shapes and rectangular shapes (as shown in FIG. 7). The slots 326 advantageously have a width 328 slightly larger than the thickness 330 of a driver 308,310.

As shown in FIGS. 3-5, the slots 326 extend at least partially through a peripheral portion of the main body 306. Although four (4) slots 326 are shown in FIGS. 3-4, the invention is not limited in this regard. The main body 306 can have any number of slots 326 selected in accordance with a particular tool assembly 200 application. For example, if a nut (or bolt) having N slots (or notches) is to be loosened using the tool assembly 200, then the main body 306 can have N slots for receiving N driver portions 334.

The recess 214 is sized and shaped for receiving the drivers 308, 310 and the plate 312. The main body 306 includes apertures 404 for receiving mechanical connectors 314. According to an embodiment of the invention, the mechanical connectors 314 are threaded mechanical connectors. In such a scenario, the apertures 404 are threaded apertures in which the mechanical connectors 314 can screwingly engage. The invention is not limited in this regard.

As shown in FIGS. 4-5, the main body 306 further comprises a guide wall 402, a stop ledge 406, and driver insert spaces 408 formed by slots 326. The guide wall 402 ensures proper alignment of the removable socket 204 and a fastener 206 (e.g., slotted, notched, spanner, castle, castellated nuts and bolts). One can appreciate that such a guide wall 402 configuration provides a tool assembly absent of the dislodgement drawbacks of conventional tool assemblies. One can also appreciate that such a guide wall 402 also prevents unequal wearing of the drivers 308, 310. The guide wall 402 can be defined by a peripheral edge 450 of the main body 306 surrounding the recess 214. The shape of the peripheral edge 450 can be annular. However, the invention is not limited in this regard. The peripheral edge 450 can have any shape selected in accordance with a particular socket 204 application. For example, the peripheral edge 450 can also have a hex-shape. The guide wall 402 extends into the interior of recess 214 a certain distance from peripheral edge 450 to transversely intersect with stop ledge 406 defined within the recess 214. Accordingly, the intersection of the guide wall 402 and stop ledge 406 form an L-shaped contour 329 within the recess 214. The same L-shaped contour 731 can be observed in FIG. 7 in the area of driver insert space 730.

The presence of each slot 326 defined in main body 306 forms a pair of opposing slot faces 307 within an interior portion of main body 306. As shown in FIG. 2, a removable driver 308, 310 is disposed between the opposing slot faces 307 when a portion of the removable driver is inserted within a slot 326. The L-shaped contour 329 formed by guide wall 402 and stop ledge 406 naturally results in a portion of each slot face 307 having an L-shaped profile. A first support face portion 331 is present on each slot face 307, adjacent to the stop ledge 406. A second support face portion 333 is defined in the area where each slot 326 traverses the guide wall 402.

The stop ledge 406 ensures that the fastener 206 (described above in relation to FIG. 2) remains in a pre-determined position within the recess 214 during the operation of the tool assembly 200. The driver insert spaces 408 are sized and shaped for receiving at least a portion of the drivers 308, 310. The driver insert spaces 408 ensure that the drivers 308, 310 remain in a pre-determined position within the main body 306 during the operation of the tool assembly 200.

Referring again to FIGS. 3-4, each of the drivers 308, 310 is formed of any suitable material as would be known to those having ordinary skill in the art. Such materials include, but are not limited to, mild steel. The phrase "mild steel", as used herein, refers to steel that has a relatively low carbon content (e.g., 0.16-0.29% carbon content). It should be noted that drivers 308, 310 formed of mild steel have an increased life span as compared to conventional drivers formed of heat treated steel.

As shown in FIGS. 3-5, each of the drivers 308, 310 has a substantially H-shape. However, the invention is not limited in this regard. For example, each of the drivers 308, 310 can have any shape selected in accordance with a particular socket 204 application. Such shapes include, but are not limited to, a substantially Z-shape (such as the drivers 602, . . . , 608 of the socket 600 shown in FIGS. 6-8), a substantially T-shape (not shown), a substantially L-shape (not shown), and a substantially U-shape (not shown).

Although two (2) drivers 308, 310 are shown in FIGS. 3-5, the invention is not limited in this regard. The socket 204 can include any number N of drivers 308, 310, where N is selected in accordance with a particular socket 204 application. For example, if the socket 204 is to be used for fastening/loosening a fastener having eight (8) gripping slots (notches), then the socket 204 can include one to four (1-4) H-shaped drivers 308, 310. Although the drivers 308, 310 are shown to be equally spaced apart, the invention is not limited in this regard. The drivers 308, 310 can be equally or non-equally spaced apart from each other. If the drivers 308, 310 are non-equally spaced apart, then the socket 204 can include two or more Z-shaped drivers (shown in FIG. 8).

Referring again to FIGS. 3-5, each of the drivers 308, 310 comprises an elongated center portion 336 having elongated parallel end portions 334 disposed at opposite ends 338, 340 thereof. The elongated end portions 334 have vertical axis 392 that are transverse to a horizontal axis 390 of the elongated center portion 336. As should be understood, the drivers 308, 310 can be machined as a single component or as a plurality of components 334, 336. If the drivers 308, 310 are machined as a plurality of components, then the end portions 334 are coupled to the elongated center portion 336 using any suitable coupling technique known to those having ordinary skill in the art. Such coupling techniques include, but are not limited to, a soldering technique and a welding technique.

Referring again to FIGS. 3-5, the elongated end portions 334 have opposing driving portions 342, 344 that extend away from the elongated center portion 336 in opposite vertical directions 550, 552. Such an opposing driving portion configuration provides a socket 204 with reversible drivers 308, 310. In this regard, it should be understood that the H-shaped drivers 308, 310 comprise two (2) sets of driving portions 360, 362. The first set of driving portions 360 can be used in different tightening/loosening operations than the second set of driving portions 362. As such, if the first set of driving portions 360 becomes worn, then the second set of driving portions 362 can be used during a next tightening/loosing operation. Such a reversible driver configuration provides a socket 204 having an increased life span as compared to conventional sockets. Also, the socket 204 is less expensive to repair and/or replace as compared to conventional socket configurations (where the sockets are machined as a single component including the drivers).

As shown in FIGS. 3-5, the elongated center portions 336 of each driver 308, 310 has a notch 354 formed therein. The notch 354 is sized and shaped to receive at least a portion of an elongated center portion 336 of another driver 308, 310. As such, the notches 354 ensure that the drivers 308, 310 reside in predefined positions with respect to each other when positioned within the main body 306.

As shown in FIG. 5, the end portions 334 of the drivers 308, 310 partially extend into the recess 214 by a certain distance d. The distance d is selected in accordance with a particular socket 204 application. As should be understood, the end portions 338, 340 are sized and shaped to fit into gripping slots (or notches) 218 of a fastener 206 (described above in relation to FIG. 2). Accordingly, the number of positions that the removable socket 204 can adopt when engaging the fastener 206 is limited.

Referring again to FIGS. 3-5, the plate 312 can be formed of any suitable material known in the art. Such materials include, but are not limited to, mild steel and aluminum. The plate 312 removably secures the drivers 308, 310 to the main body 306. In this regard, it should be understood that the plate 312 includes apertures 410. The apertures 410 are sized and shaped for receiving the mechanical connectors 314. The plate 312 is sized and shaped to fit within the recess 214 of the main body 306. As should be understood, the removable plate configuration advantageously facilitates the provision of a socket 204 with removable and reversible drivers 308, 310. However, the invention is not limited in this regard. For example, if the drivers 308, 310 are configured to snap into the main body 306, then the removable socket 204 can be absent of the plate 312.

Figure 6:
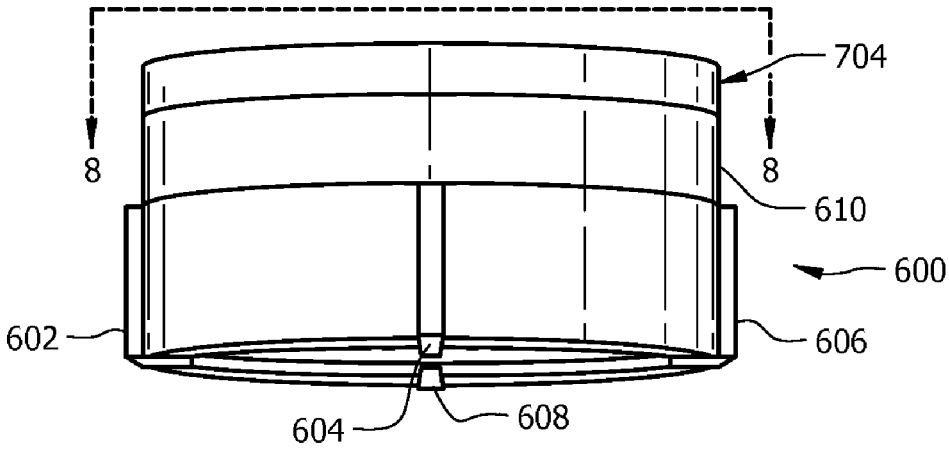
FIG. 6 is a perspective view of another exemplary removable socket of the tool assembly of FIG. 2 that is useful for understanding the present invention.
Figure 8:
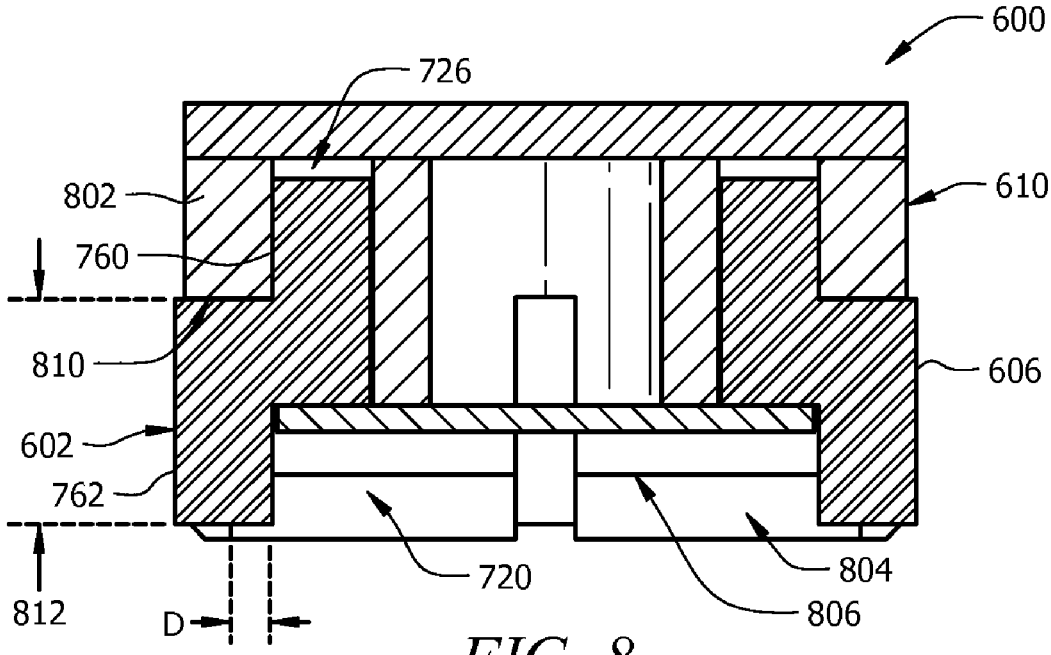
FIG. 8 is a cross sectional view of the exemplary removable socket taken along line 8-8 of FIG. 6.

Referring now to FIGS. 6-8, there are provided schematic illustrations of another exemplary removable socket 600 that is useful for understanding the present invention. More particularly, a perspective view of the removable socket 600 is provided in FIG. 6. An exploded perspective view of the removable socket 600 is provided in FIG. 7. A cross-sectional view of the removable socket 600 taken along line 8-8 of FIG. 6 is provided in FIG. 8.

As shown in FIGS. 6-8, the removable socket 600 comprises mechanical connectors 702, 714 and plates 704, 712. These listed components 702, 704, 712, 714 are the same as or substantially similar to the mechanical connectors 302, 314 and plates 304, 312 of FIGS. 3-5, respectively. As such, the discussion provided above in relation to the components 302, 304, 312, 314 is sufficient for understanding the components 702, 704, 712, 714 of the removable socket 600.

Referring again to FIGS. 6-8, the removable socket 600 is also comprised of a main body 610 and drivers 602, 604, 606, 608. The main body 610 is formed of any suitable material known to those having ordinary skill in the art. Such materials include, but are not limited to, brass. The main body 610 is comprised of apertures 722, 724, 726, driver insert spaces 730, and a recess 720. The main body 610 is also comprised of apertures (not shown) for receiving the mechanical connectors 714. The apertures (not shown) can be threaded apertures. The recess 720 is sized and shaped for receiving at least a portion of the drivers 602, 604, 606, 608, the plate 712, and a fastener (e.g., the fastener 206 of FIG. 2). As should be understood, the recess 720 is designed so that the portion of the fastener inserted therein substantially fills the recess 720.

The apertures 722 are sized and shaped for receiving the mechanical connectors 702. As such, the apertures 722 can be threaded apertures. The aperture 724 of the main body 610 is sized and shaped for receiving the driving shaft (or member) 216 of the wrench 202 (described above in relation to FIG. 2). In this regard, it should be understood that the aperture 724 can have dimensions (not shown) selected for receiving driving shaft (or member) 216 having different sizes. As such, the main body 610 can be used in tool assembly applications where wrenches with different sized and shaped driving shafts (or members) are employed for tightening or loosening fasteners (e.g., a nut). One can appreciate that such a main body 610 configuration facilitates a universal tool assembly 200 that is less expensive to manufacture and repair as compared to conventional tool assemblies.

The driver insert spaces 730 are provided to ensure that the drivers 602, 604, 606, 608 remain in a pre-determined position within the main body 610 during the operation of a tool assembly. As such, the driver insert spaces 730 are configured for receiving at least a portion of a driver 602, . . . , 608. The driver insert spaces 730 can have any shape selected in accordance with the particular shape of the drivers 602, . . . , 608. For example, if the drivers 602, . . . , 608 are Z-shaped drivers (as shown in FIGS. 7-8), then the driver insert spaces 730 can be Z-shaped insert spaces (as shown in FIG. 8).

As shown in FIGS. 6-8, a portion of the driver insert spaces 730 can extend at least partially through a peripheral portion 802 of the main body 610. In such a scenario, slots (or notches) 752 are formed in a radial configuration along the peripheral portion 802 of the main body 610. Although the main body 610 is shown to have four (4) driver insert spaces 730, the invention is not limited in this regard. The main body 610 can have any number of driver insert spaces 730 selected in accordance with a particular socket 600 application. For example, if a nut (or bolt) having N slots (or notches) is to be loosened using the socket 600, then the main body 610 can have N driver insert spaces 730 for receiving N drivers 602, . . . , 608.

A shown in FIG. 8, stop ledges 810 can be provided for ensuring that the drivers 602, . . . , 608 are inserted a distance 812 into the main body 610. The stop ledges 810 can also ensure that the drivers 602, . . . , 608 reside in predefined positions with respect to each other when positioned within the main body 610. More particularly, the stop ledges 810 ensure that the drivers 602, . . . , 608 reside in the same plane defined by the recess 720 and are horizontally aligned with each other.

As shown in FIG. 8, the main body 610 further comprises a guide 804 and a stop ledge 806. The components 804, 806 of the main body 610 are the same as or substantially similar to the components 402, 406 of the main body 306 (described above in relation to FIGS. 3-5), respectively. As such, the discussion provided above in relation to FIGS. 3-5 is sufficient for understanding the components 804, 806 of the main body 610.

Referring again to FIGS. 6-8, each of the drivers 602, . . . , 608 can be formed of any suitable material known to those having ordinary skill in the art. Such materials include, but are not limited to, mild steel. Each of the drivers 602, . . . , 608 can have a substantially Z-shape. Although four (4) Z-shaped drivers 602, . . . , 608 are shown, the invention is not limited in this regard. The socket 600 can include any number N of drivers 602, . . . , 608, where N is selected in accordance with a particular socket 600 application. For example, if the socket 600 is to be used for fastening/loosening a fastener having eight (8) gripping slots (notches), then the socket 600 can include one to eight (1-8) Z-shaped drivers 602, . . . , 608.

As shown in FIG. 7-8, each of the drivers 602, . . . , 608 comprises two (2) opposing driving portions 760, 762. Such an opposing driving portion configuration provides a socket 600 with reversible drivers 602, . . . , 608. In this regard, it should be understood that a first one of driving portions 760 can be used in different tightening/loosening operations than a second one of driving portions 762. As such, if the first driving portion 760 becomes worn, then the second driving portions 762 can be used during a next tightening/loosing operation. One can appreciate that such a reversible driver configuration provides a socket 600 having a longer life span as compared to conventional sockets. Also, the socket 600 is less expensive to repair and/or replace as compared to conventional socket configurations (where the sockets are machined as a single component including the drivers).

It should be noted that the drivers 602, . . . , 608 can be fabricated with different shaped features so that the socket 600 can drive different fasteners. The different fasteners can have notches with different widths and notches with different shapes. Such a driver feature configuration enables the driving of fasteners 206 with internal cylindrical recesses (as opposed to recesses formed on a peripheral portion thereof).

As shown in FIG. 8, the driving portions 762 of the drivers 602, . . . , 608 partially extend into the recess 720 by a certain distance D. The distance D is selected in accordance with a particular socket 600 application. The invention is not limited in this regard. For example, if the drivers 602, . . . , 608 are inserted into the driver insert spaces 730 in an orientation reverse than that shown in FIG. 8, then the driving portions 760 will partially extend into the recess 720 by the distance D. As should be understood, the driving portions 760, 762 are sized and shaped to fit into gripping slots (or notches) of a fastener (e.g., the fastener 206 described above in relation to FIG. 2). Accordingly, the number of positions that the removable socket 600 can adopt when engaging a fastener is limited.

All of the apparatus, methods and algorithms disclosed and claimed herein can be made and executed without undue experimentation in light of the present disclosure. While the invention has been described in terms of preferred embodiments, it will be apparent to those of skill in the art that variations may be applied to the apparatus, methods and sequence of steps of the method without departing from the concept, spirit and scope of the invention. More specifically, it will be apparent that certain components may be added to, combined with, or substituted for the components described herein while the same or similar results would be achieved. All such similar substitutes and modifications apparent to those skilled in the art are deemed to be within the spirit, scope and concept of the invention as defined.

We claim:

1. A socket for use with a wrench having a shaft to drive said socket for tightening or loosening a fastener having at least one gripping notch, comprising:

a main body having a recess being of such dimensions that at least a portion of said fastener fills said recess when inserted therein; and at least one removable driver having at least one driving element sized and shaped to fit within said at least one gripping notch, said removable driver being removably disposed within said main body in an orientation in which said at least one driving element at least partially protrudes into said recess;

at least one slot formed on a peripheral portion of said main body, said slot defining opposing slot faces of said main body within an interior portion of said slot, each said slot face comprising an L-shaped profile defined by a peripheral guide wall of said main body and an annular stop ledge formed within said recess of said main body, each said slot face further including a first support face portion adjacent to said stop ledge for supporting said removable driver along a horizontal axis direction and a second support face portion formed where said slot traverses said peripheral wall of said main body for supporting said removable driver along a vertical axis direction.

2. The socket according to claim 1, wherein said main body further comprises a guide configured for aligning said socket and said fastener.

3. The socket according to claim 2, wherein said guide is defined by a peripheral edge of said main body surrounding said recess.

4. The socket according to claim 1, further comprising a retaining plate removably coupled to said main body so as to retain said at least one removable driver within said main body.

5. The socket according to claim 1, wherein said at least one removable driver comprises two opposing driving elements sized and shaped to fit within said at least one gripping notch.

6. The socket according to claim 5, wherein said at least one removable driver is removably disposed within said main body in a first orientation in which a first one of said at least two opposing driving elements protrudes into said recess or a second orientation in which a second one of said at least two opposing driving members protrudes into said recess, said first orientation being opposite to said second orientation.

7. The socket according to claim 1, further comprising a plate having a centrally located aperture sized and shaped to engagingly receive said shaft for rotation therewith, said plate removably secured to a first end of said main body opposed from a second end of said main body in which said recess is formed.

8. The socket according to claim 7, wherein said main body further comprises an aperture having dimensions greater than dimensions of said shaft and aligned with said centrally located aperture of said plate.

9. The socket according to claim 1, wherein said stop ledge is configured for ensuring that said fastener is inserted a pre-defined distance within said recess.

10. A socket for use with a wrench having a shaft to drive said socket for tightening or loosening a fastener having at least one gripping notch, comprising:

a main body having a recess being of such dimensions that at least a portion of said fastener fills said recess when inserted therein; and at least one reversible driver having at least two opposing driving members sized and shaped to fit within said at least one gripping notch, said reversible driver being removably disposed within said main body in a first or second orientation, said first orientation reverse from said second orientation;

wherein a first one of said at least two opposing driving members protrudes into said recess when said at least one reversible driver is in said first orientation and a second one of said at least two opposing driving members protrudes into said recess when said at least one reversible driver is in said second orientation; and wherein at least one slot is formed on a peripheral portion of said main body, said slot defining opposing slot faces of said main body within an interior portion of said slot, each said slot face comprising an L-shaped profile defined by a peripheral guide wall of said main body and an annular stop ledge formed within said recess of said main body, each said slot face further including a first support face portion adjacent to said stop ledge for supporting said removable driver along a horizontal axis direction and a second support face portion formed where said slot traverses said peripheral wall of said main body for supporting said removable driver along a vertical axis direction.

11. The socket according to claim 10, wherein said main body further comprises a guide configured for aligning said socket and said fastener.

12. The socket according to claim 11, wherein said guide is defined by a peripheral edge of said main body surrounding said recess.

13. The socket according to claim 10, further comprising a retaining plate removably coupled to said main body so as to retain said at least one reversible driver within said main body.

14. The socket according to claim 10, further comprising a plate having a centrally located aperture sized and shaped to engagingly receive said shaft for rotation therewith, said plate removably secured to a first end of said main body opposed from a second end of said main body in which said recess is formed.

15. The socket according to claim 14, wherein said main body further comprises an aperture having dimensions greater than dimensions of said shaft and aligned with said centrally located aperture of said plate.

16. A socket for use with a wrench having a shaft configured to drive said socket for tightening or loosening a fastener, comprising:

a main body comprising two opposing ends and a recess formed in a first one of said opposing ends, said recess being of such dimensions that at least a portion of said fastener fills said recess when inserted therein;

a first plate removably coupled to a second one of said two opposing ends, said first plate comprising a centrally located aperture sized and shaped to engagingly receive said shaft for rotation therewith;

at least one removable driver having at least one driving element sized and shaped to fit within a gripping notch of said fastener, said removable driver being removably disposed within said main body in an orientation in which said at least one driving element at least partially protrudes into said recess;

at least one slot formed on a peripheral portion of said main body, said slot defining opposing slot faces of said main body within an interior portion of said slot, each said slot face comprising an L-shaped profile defined by a peripheral guide wall of said main body and an annular stop ledge formed within said recess of said main body, each said slot face further including a first support face portion adjacent to said stop ledge for supporting said removable driver along a horizontal axis direction and a second support face portion formed where said slot traverses said peripheral wall of said main body for supporting said removable driver along a vertical axis direction.

17. The socket according to claim 16, wherein said main body further comprises a guide configured for aligning said socket and said fastener.

18. The socket according to claim 16, wherein said at least one removable driver comprises two opposing driving elements sized and shaped to fit within a gripping notch of said fastener.

19. The socket according to claim 18, wherein said removable driver is removably disposed within said main body in a first orientation in which a first one of said at least two opposing driving elements protrudes into said recess or a second orientation in which a second one of said at least two opposing driving members protrudes into said recess, said first orientation being opposite to said second orientation.

* * * * *